US005768993A

United States Patent [19]

Stuart

[11] Patent Number: 5,768,993

[45] Date of Patent: Jun. 23, 1998

[54] INKING SYSTEM FOR OFFSET PRINTERS

[75] Inventor: Warner Hugh Stuart, Thatcher, Id.

[73] Assignee: Bryce International, L.L.C., Memphis, Tenn.

[21] Appl. No.: 853,407

[22] Filed: May 9, 1997

[51] Int. Cl.[6] ..... B41F 31/04; B41F 31/06; B41F 31/08

[52] U.S. Cl. ..... 101/366; 101/425; 101/483

[58] Field of Search ..... 101/366, 363, 101/364, 350.1, 350.5, 207–210, 148, 365, 483, 425, 423, 157, 169; 118/259, 261

[56] References Cited

U.S. PATENT DOCUMENTS

| | | | |
|---|---|---|---|
| 5,010,817 | 4/1991 | Grosshauser | 101/350 |
| 5,213,044 | 5/1993 | Elis | 101/366 X |
| 5,406,887 | 4/1995 | Hertel et al. | 101/366 |

*Primary Examiner*—J. Reed Fisher
*Attorney, Agent, or Firm*—Luedeka, Neely & Graham, P.C.

[57] ABSTRACT

The specification describes an apparatus for providing a fluid under pressure to an exterior surface of an elongate cylinder. The apparatus is comprised of an elongate housing having a fluid collection chamber havingan opening positionable adjacent the exterior surface of the cylinder and an elongate nozzle in the housing which is projected through the opening in close proximity to the exterior surface of the cylinder. The nozzle has a length which is about equal to the length of the cylinder and a width which is less than the diameter of the cylinder. Conduits are connected in fluid flow communication with the nozzle and chamber in order to provide a flow of ink or cleaning fluid to the nozzle for inking or cleaning the cylinder under pressure and to maintain a reduced pressure in the chamber relative to the pressure of fluid exiting the nozzle. The apparatus provides the ability to deliver ink or cleaning fluids under pressure and relatively high velocity to the cylinder for more adequate filling and cleaning of the cylinder without the need for elaborate seals to contain the ink or cleaning fluid within the boundaries of the apparatus during the operation thereof.

20 Claims, 7 Drawing Sheets

INKING SYSTEM FOR OFFSET PRINTERS

FIELD OF THE INVENTION

The invention relates to ink delivery and cleaning systems for offset printing machines.

BACKGROUND

Offset printing systems generally contain an ink transfer cylinder or roll having cells or indentations for retaining ink which is operatively associated with a printing cylinder or roll. The printing cylinder typically contains an elastomeric die having a pattern according to the image to be printed on a substrate. By rolling contact ink is transferred from the transfer cylinder to the die on the print cylinder and thence from the die on the print cylinder to the substrate. To assure a fine film of ink on the ink transfer cylinder with uniform thickness, either a doctor blade or doctor roll is maintained in contact with the ink transfer roll during the printing operation.

The ink may be applied to the ink transfer cylinder for a gravure or flexographic printing system by rotating the cylinder with a part of its surface immersed in an ink bath in an ink pan or by feeding ink to the cylinder from a gravity feed tank which is located above the transfer cylinder. Ink dipping pans and gravity feed systems require a large volume of ink be maintained within the inking unit to insure complete coverage of ink on the ink transfer cylinder. At high rotational speeds of the transfer cylinder, gravity feed or cylinder dipping system may not completely fill the cells or indentations on a gravure or anilox roll. Decreasing the rotation speed of the ink transfer cylinder to increase the ink coverage of the cylinder is not a satisfactory solution because it results in decreased production.

Various methods have been proposed to increase the inking efficiency of the ink transfer cylinder. The use of a rubber covered pressure roll to squeeze ink from an ink pan into the cells or indentations of an anilox roll is described in U.S. Pat. No. 3,818,830 to Schultz, however, as the pressure roll wears, adjustment of the pressure roll relative to the transfer cylinder may be required.

In addition to difficulties encountered when using conventional inking systems to fill the cells or indentations of an ink transfer roll with ink, cleaning of such systems has been difficult. The ink supply rolls and ink chambers must be thoroughly cleaned between printing runs or between color changes. Printing systems are often cleaned manually by an operator who pours or sprays water or some other solvent into the ink trough, into the ink chamber and/or into the gravity feed tank as well as the ink transfer cylinders and the associated equipment and parts. The operator then scrubs the surfaces of the printing system with a cloth to remove ink and the cleaning solvent.

Automatic systems for cleaning printing machines have been proposed such as the cleaning system described in U.S. Pat. No. 3,896,730 to Garrett et al. However such systems cannot provide wash liquids at high pressures and high velocities since they use the same ink gravity feed chambers for cleaning as are used to supply ink to the transfer cylinders.

Spray cleaning systems such as the system described in U.S. Pat. No. 4,534,291 to Sabota et al. have also been proposed. However the pressure and volume of wash liquid which can be used with such a spray system is limited. Due to their design, the inking chambers cannot be effectively used to clean the cylinders since the ink chambers are not designed for pressure operation. Accordingly, the inking chamber and ink conduits must be cleaned in a separate cleaning operation.

As the cost for ink and ink cleaning solutions increases because of the cost of raw materials and increased pressure to provide environmentally responsible inks and solvents, there continues to be a need to provide improved inking and ink cleanup systems for printing machines which are adaptable for a wide variety of inks and cleaning solvents and which are less costly to install, maintain and use.

Accordingly, it is an object of the invention to provide an improved inking system for an offset printing machine.

Another object of the invention is to provide an improved apparatus and method for cleaning a printing machine.

An additional object of the invention is to provide a inking apparatus which can be angularly adjusted along the circumference of an ink transfer roll for a flexographic printing machine.

Yet another object of the invention is to provide a ink feed and cleaning system which provides ink and cleaning solutions to an ink transfer roll for a flexographic printing machine under high pressure and high velocity in a manner which minimizes exfiltration of ink to the ambient environment.

Still another object of the invention is to provide a method and apparatus for degassing ink provided to an ink transfer cylinder under pressure.

Another object of the invention is to provide an inking system having no mechanical seals between the ink transfer roll and inking apparatus.

SUMMARY OF THE INVENTION

Having regard to the above and other objects and advantages, the invention provides an apparatus for delivering a flow of fluid onto the surface of an elongate cylinder having a cylindrical exterior surface, the apparatus comprising an elongate housing having an opening positionable adjacent the exterior surface of the cylinder and a fluid collection chamber. The housing contains an elongate nozzle within the ink collection chamber which is in fluid flow communication with the collection chamber and is projectable through the opening of the housing for placement of the nozzle in close proximity to the exterior surface of the cylinder. The nozzle has a length about equal the length of the cylinder and a width less than the diameter of the cylinder. A first conduit connects the fluid collection chamber in fluid flow communication with a vacuum device for establishing a reduced pressure in the chamber through the first conduit. A second conduit connects the fluid chamber in fluid flow communication with a fluid reservoir for conducting a flow of fluid into the reservoir from the collection chamber. A fluid transfer device connects the fluid reservoir in fluid flow communication with the nozzle for supplying fluid from the reservoir to the nozzle under pressure. Elongate wiper seals are disposed adjacent the opening of the housing oriented substantially parallel to the length of the housing and are positionable in close adjacency with the exterior surface of the cylinder.

In another aspect, the invention relates to a method for inking and/or cleaning an elongate anilox or gravure cylinder having an exterior surface which comprises providing an inking and/or cleaning device comprising elongate housing having an opening positionable adjacent the exterior surface of the cylinder and an ink collection chamber. The housing contains an elongate nozzle within the fluid collection chamber which is in fluid flow communication with the collection chamber and is projectable through the opening of the housing for placement of the nozzle in close proximity to the exterior surface of the cylinder. The nozzle has a length about equal the length of the cylinder and a width less than the diameter of the cylinder. A first conduit connects the fluid collection chamber in fluid flow communication with a vacuum device for establishing a reduced pressure in the chamber through the first conduit. A second conduit connects the fluid chamber in fluid flow communication with a fluid reservoir for conducting a flow of ink or cleaning fluid into the reservoir from the collection chamber. An ink or cleaning fluid transfer device connects the ink reservoir in fluid flow communication with the nozzle for supplying ink or cleaning fluid from the reservoir to the nozzle under pressure. Elongate wiper seals are disposed adjacent the opening of the housing oriented substantially parallel to the length of the housing and are positionable in close adjacency with the exterior surface of the cylinder. Ink or cleaning fluid is fed to the nozzle under pressure sufficient to substantially fill cells or indentations on the exterior surface of the cylinder.

In yet another aspect of the invention, the housing is mounted relative to the elongate cylinder by use of mounting plates attached to opposing ends of the housing. The mounting plates contain journal bearings for mounting the housing on an axle of the cylinder so that the housing can be moved in an arcuate direction relative to the surface of the cylinder to a position between about 15° above a horizontal axis perpendicular to the surface and about 45° below the horizontal axis. The ability to move the housing relative to the elongate cylinder permits the use of inks which may require more or less exposure time to the atmosphere before the ink contacts the cylinder.

Another advantage of the apparatus described herein is that it provides an inking system for a flexographic printer which requires only a small volume of ink be in contact with the elongate cylinder during printing. Because only a small amount of ink is in the housing, ink changes and cleanup times are reduced. Furthermore, because the ink and cleaning fluids are provided to the cylinder under pressure and high velocity through the nozzle, more complete filling of the cells or indentations of the ink transfer roll with ink or cleaning fluids is possible without disassembling the printer.

During the inking operation, a low or subatmospheric pressure is maintained in the collection chamber surrounding the nozzle. Accordingly, ink leakage at the lateral ends of the housing is minimized or eliminated thereby obviating a need for mechanical seals to seal between the ends of the housing and the cylinder roll.

BRIEF DESCRIPTION OF THE DRAWINGS

Other features and advantages of the invention will now be further described in the following detailed description of a preferred embodiment of the invention considered in conjunction with the drawings in which.

DETAIL DESCRIPTION OF THE INVENTION

Figure 1:
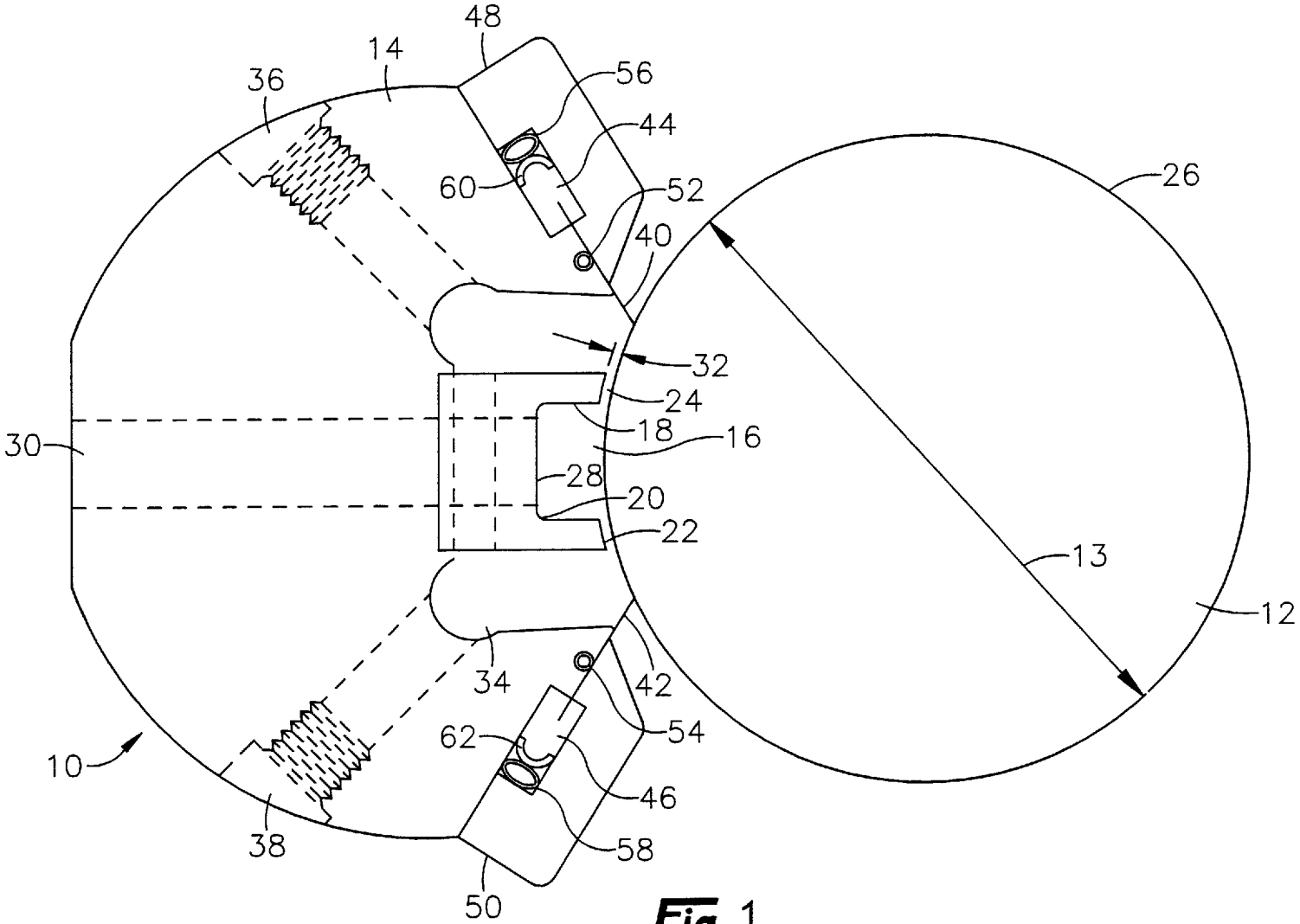
FIG. 1 is a cross-sectional view, not to scale, of a housing and nozzle according to the invention positioned relative to a cylinder for a printing machine.

With reference to FIG. 1, there is shown an apparatus 10 for delivering fluid onto the surface of an elongate cylinder 12. The apparatus 10 comprises a housing 14 and a nozzle 16 which is positionable in closely adjacency with the exterior surface 26 of the cylinder defining metering seals 22 and 24. The nozzle 16 has a length about equal to the length of the cylinder 12 and a width less than the diameter 13 of the cylinder. In order to minimize the amount of ink or cleaning fluid required for inking or cleaning the cylinder 12, the volume of the nozzle defined by walls 18, 20 and 28 is preferably no more than about 0.5 $in^2$, most preferably no more than about 0.375 $in^2$.

Ink or cleaning fluid is fed to the nozzle 16 via conduit 30 which is in flow communication with the nozzle 16 and an ink or cleaning reservoir (not shown). The metering seals 22 and 24 provide a metering gap 32 which induces a high velocity of ink or cleaning fluid from the nozzle 16 to the surface 26 of the cylinder during the inking or cleaning operation. The gap 32 may be as much as about 0.008 inch (0.203 mm) or as little as about 0.001 inch (0.025 mm). Preferably the gap 32 is from about 0.003 inch (0.076 mm) to about 0.005 inch (0.127 mm). Because the pressure and flow rate of ink to the nozzle 16 can be varied, the speed of the cylinder 12 may be changed to accommodate various printing speeds.

The nozzle 16 is within the fluid collection chamber 34 and is projectable through an opening in the housing 14. The fluid collection chamber 34 in the housing contains a vacuum conduit 36 in flow communication with the chamber 34 to remove excess air which may be entrained in the ink provided to the nozzle 16 and ink cylinder 12. The chamber 34 in the housing 14 may be any suitable size sufficient to substantially envelop the nozzle 16, provided chamber 34 is not so small that it disrupts the flow of ink from the nozzle 16 to the cylinder 12. A chamber 34 having a volume of no less than about 0.8 $in^2$ is suitable for many applications according to the invention.

An ink return conduit 38 is provided in flow communication with collection chamber 34 to flow ink or cleaning fluid from the chamber 34 to a reservoir or disposal system (not shown). Excess ink or cleaning fluid flowing from nozzle 16 through seals 22 and 24 is collected in chamber 34 where it flows by vacuum and/or gravity to the reservoir or disposal system.

Because the design of the housing 14 accommodates maintaining a differential pressure between the fluid collection chamber 34 and nozzle 16, mechanical sealing requirements on opposing ends of the housing 14 adjacent the external surface of the cylinder 12 are not required. Furthermore, excess ink and cleaning fluid may be removed from the housing 14 by a combination of gravity and differential pressure thereby increasing the flow rate and decreasing the amount of excess ink or cleaning fluid in the chamber 34 so that it is not forced out of the ends of the housing 14.

The apparatus 10 of the invention also comprises elongate wiper seals 40 and 42 disposed adjacent the opening of the housing 14. The wiper seals 40 and 42 are oriented substantially parallel to the length of the housing 14 and are positionable in close adjacency with the exterior surface of the cylinder. In a preferred embodiment, the wipers seals 40 and 42 are doctor blades which are attached to the housing 14 along its longitudinal length and which provide for smoothing and removal of excess ink or cleaning fluid on the surface 26 of the cylinder 12 during the inking and/or cleaning process. The doctor blades 40 and 42 are elongate resilient materials having a thickness sufficient to provide rigidity to the blades as the blades contact the surface 26 of the cylinder 12.

It is preferred that the blades contact the surface 26 of the cylinder 12. In order to provide substantially constant contact between the blades 40 and 42 and the surface 26 of cylinder 12, the blades are held by blade holders 44 and 46 in sliding relationship between blade caps 48 and 50 and the housing 14. Blade seals 52 and 54 are disposed on housing 14 between the end of the blades in contact with cylinder 12 and blade holders 44 and 46. The blade seals 52 and 54 are made from a resilient material and provide a sealing relationship between blades 40 and 42 and housing 14 in order to prevent ink and cleaning fluids from contacting blade holders 44 and 46.

Constant pressure of the blades 40 and 42 with surface 26 is provided by inflating pneumatic tubes 56 and 58 made of an elastomeric material which urge blade holder tops 60 and 62 toward the cylinder 12 as the blades wear. Because the pneumatic tubes 56 and 58 extend substantially along the length of the blade holders 44 and 46, even pressure of the blades 40 and 42 with respect to cylinder surface 26 over the entire length of the cylinder is provided.

The method for providing pressure on the blades 40 and 42 to urge the blades toward the cylinder 12 is not limited to the use of pneumatic tubes 56 and 58. Other methods for urging the blades 40 and 42 toward the cylinder 12 may be used including spring loaded pins, small air cylinders, coiled springs, leaf springs, compressed elastomeric materials, pneumatic cylinders and the like.

Figure 2:
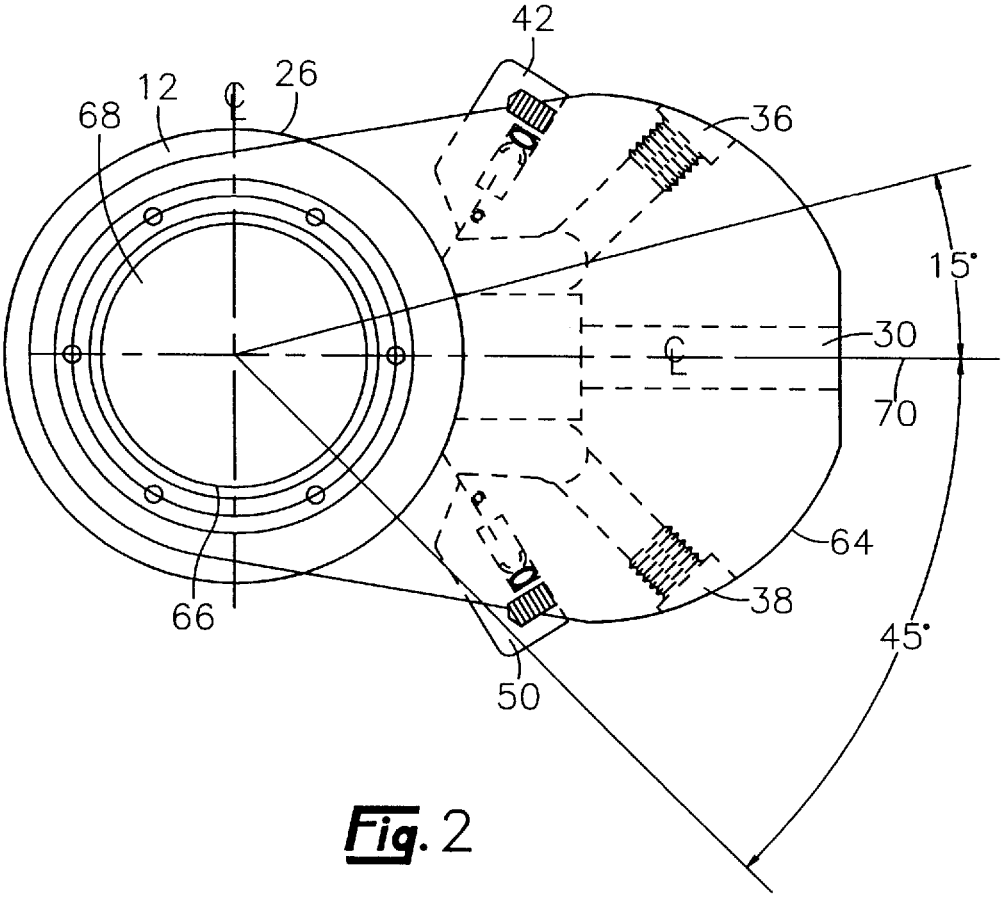
FIG. 2 is a cross-sectional view, not to scale of a mounting system for a housing according to the invention mounted on a cylinder axle.

The housing 14 is held in metering relationship with the surface 26 of cylinder 12 by mounting plates 64 (FIG. 2) which are attached with journal bearings 66 to the axle 68 of the cylinder 12. Because the housing 14 is mounted on bearings 66, the entire body 14 (FIG. 1) may be moved in an arcuate direction relative to the surface 26 of cylinder 12. With respect to a horizontal axis 70 perpendicular to the surface 26 of cylinder 12, it is preferred that the housing 14 move no more than about 15 degrees above the horizontal axis 70 and about 45 degrees below the horizontal axis 70. Movement of the housing 14 relative to the cylinder surface 26 provides a means for increasing or decreasing the time ink on the surface 26 of cylinder 12 is exposed to the atmosphere before being transferred to a printing cylinder (not shown).

The housing 14, nozzle 16 and wiper seals 40 and 42 may be made of any suitable material including wood, metals and polymeric materials provided the materials are compatible with the inks and solvents used with the system. A particularly preferred material for the housing 14, nozzle 16, blade holder 44 and blade caps 48 and 50 is nylon (FIG. 1). The wiper seals 40 and 42 are preferably made from ferrous metals. However, other materials known to those of ordinary skill and conventionally used in such applications may be used.

Figure 3:
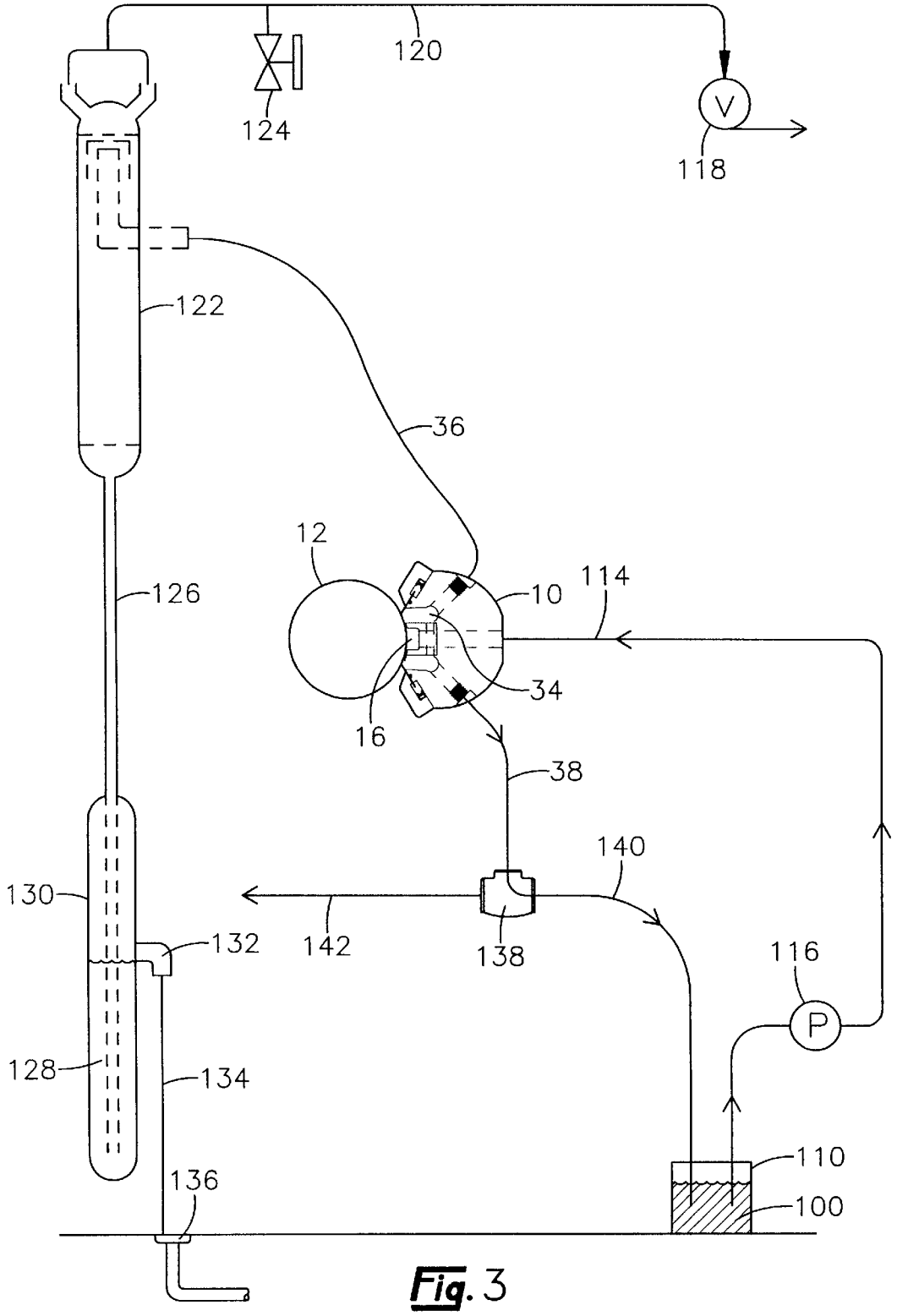
FIGS. 3, 4, 5, 6 and 7 are process flow diagrams for inking and ink cleaning operations using the apparatus of the invention.

Operation of the apparatus 10 during the inking and cleaning process will now be described with reference to FIGS. 3, 4, 5, 6 and 7. Referring to FIG. 3, ink 100 from reservoir 110 is pumped through pressure conduit 114 to the nozzle 16 disposed in the housing 14 by pump 116. The pressure of ink discharging from pump 116 is determined by the pump head and pressure drop through ink metering gaps 32 (FIG. 1). The pressure may be adjusted to provide even distribution of ink across the surface 26 (FIG. 1) of the cylinder 12 by increasing or decreasing the metering gaps 22 and 24 by moving the housing 14 relative to the cylinder 12 or by increasing or decreasing the ink flow rate to the nozzle 16. Ink pressures in the range of from about 10 to about 20 psig are typical for conventional inks. Higher pressures may be used when operating at higher printing speeds.

Because the ink is forced through the metering gap 32 with relatively high pressure, a relatively high velocity of ink is maintained. The high velocity of ink provides more complete filling of the cells or indentations on the surface 26 of the transfer cylinder 12, and, during the cleaning operation, provides a forced scrubbing action across the surface 26 of the cylinder 12. By adjusting the ink pressure and/or ink flow rate from nozzle 16, the ink flow rate to the cylinder 12 can be controlled to accommodate various printing speeds and ink characteristics.

During the inking and cleaning operations, a reduced pressure relative to the nozzle pressure, preferably a subatmospheric pressure, is maintained in the fluid collection chamber 34 by vacuum pump 118. The pressure in chamber 34 is maintained in the range of from about 10 inches to about 30 inches of water vacuum, preferably from about 15 to about 25 inches of water vacuum. Because the pressure in chamber 34 is maintained under a lower pressure than the pressure of fluid exiting nozzle 16, ink will flow by gravity from chamber 34 through conduit 38 rather than out through the sides of the housing 14. Hence, the sealing arrangement for sides of the housing 14 relative to the surface of the cylinder 12 is considerably simplified.

Vacuum pump 118 is connected in fluid flow communication through conduit 120 with separator vessel 122 which is connected in fluid flow communication with fluid collection chamber 34 by means of vacuum conduit 36. Valve 124 in conduit 120 may opened or closed in order to adjust the pressure in vessel 122 and chamber 34 so as to reduce entrainment of ink in vacuum conduit 36. Any fluid which may be entrained in conduit 36 will flow back through the chamber 34 and through conduits 38 and 140 into reservoir 110.

Vessel 122 is provided with a dip pipe 126 which maintained below the level of a liquid 128 in seal pot vessel 130. As liquid drains from vessel 122, it accumulates in seal pot vessel 130. In order to keep the liquid 128 at a preset level, vessel 130 has an overflow drain 132 located at the desired liquid level. Excess liquid from vessel 130 flows through conduit 134 to a floor drain 136 or waste disposal system (not shown).

Excess ink or cleaning fluid provided by nozzle 16 to the surface of the cylinder 12 flows by gravity from chamber 34 through a conduit 38, a three-way valve 138 and conduit 140 to reservoir 110. Conduit 142 provides as an alternate route for the fluid which is used during the cleaning operation described below with reference to FIGS. 4,5,6 and 7.

Figure 4:
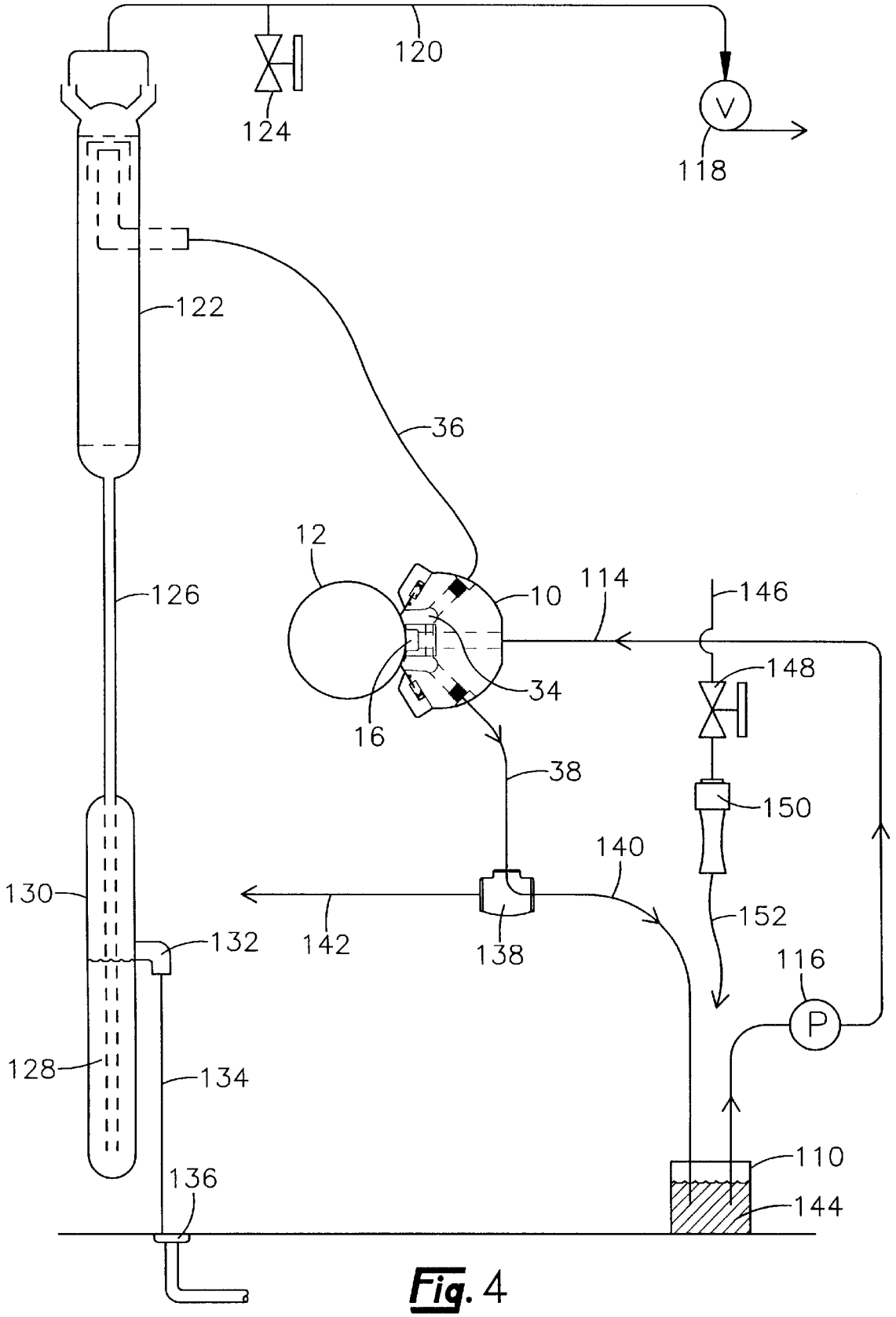

With reference to FIG. 4, reservoir 110 which contained ink during the inking process is either drained or replaced with a reservoir containing a cleaning fluid 144 such as water. Additional water may be provided to reservoir 110 from a plant water supply conduit through valve 148, eductor 150 and conduit 152.

The water may be circulated through the apparatus 10 in the same manner that ink is circulated from reservoir 110 to the nozzle 16 and housing 14 and back to reservoir 110. Pump 116 provides water through conduit 114 to the nozzle 16. If desired, a reduced or subatmospheric pressure may be maintained during the cleaning process on chamber 34 and through conduits 120 and 36 and separator vessel 122 by vacuum pump 118.

Water flowing to nozzle 16 is provided under high pressure and high velocity to the surface 26 (FIG. 1) of cylinder 12 in order to fill and thereby clean the cells and indentations on the cylinder. Excess water flows into fluid collection chamber 34 and through conduits 38 and 140 and valve 138 to reservoir 110.

Figure 5:
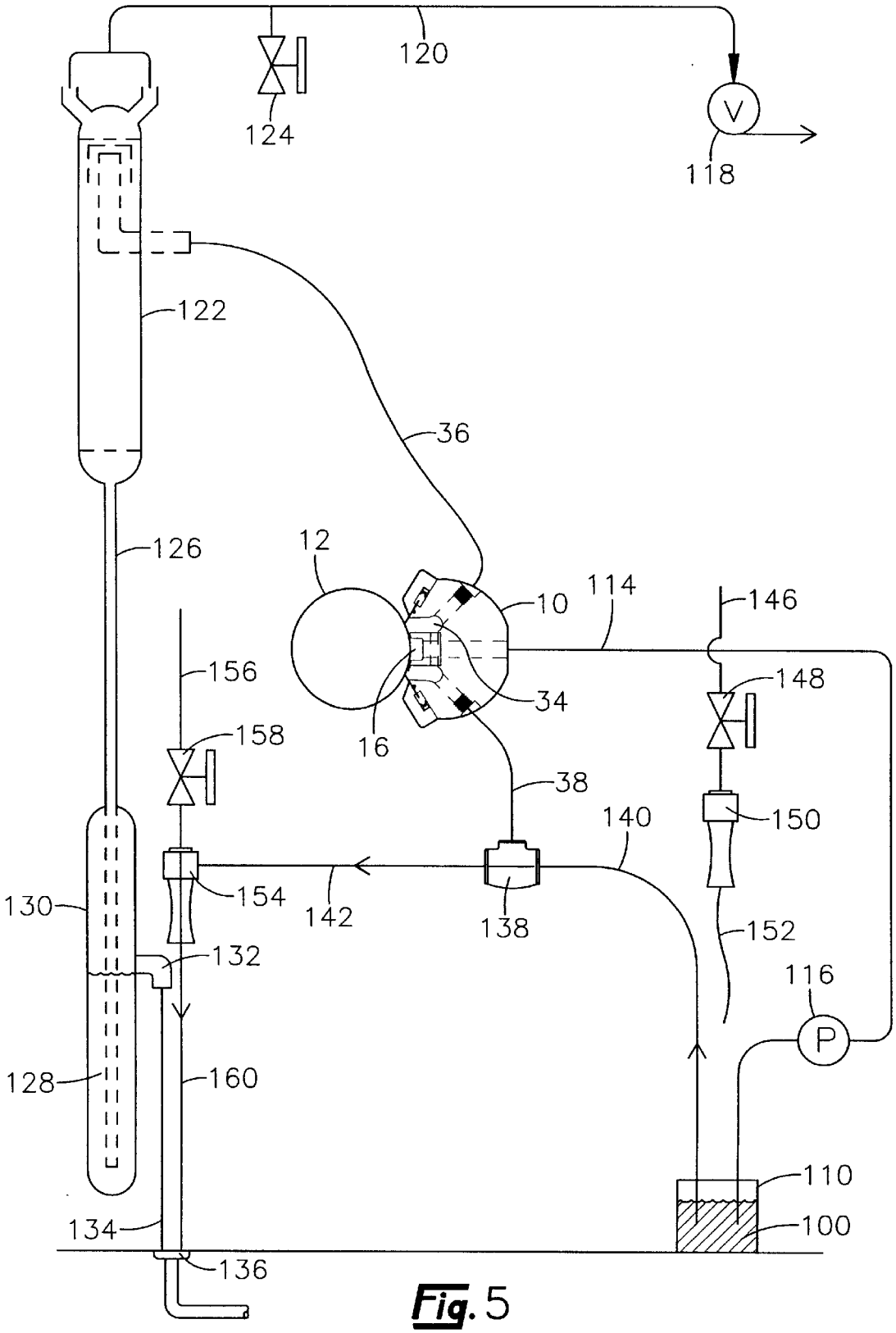

Now with reference to FIG. 5, after circulating water or cleaning fluid through the nozzle 16 and chamber 34 for a period of time, the fluid in reservoir 110 may be changed to provide clean fluid for further cleaning of the apparatus 10 and associated conduits. In order to change the fluid, three-way valve is operated to direct the fluid 100 containing ink through conduits 140 and 142 to eductor 154. Plant water is provided to eductor 154 through conduit 156 by opening valve 158 in order to provide a motive force to move fluid from reservoir 110 to the eductor 154. If desired, additional plant water may be provided to reservoir 110 to dilute the ink/fluid mixture 100 in the reservoir by opening valve 148 so that water flows through conduits 146 and 152 and eductor 150 into reservoir 110.

Eductor 154 draws the fluid through conduit 142 by well known eductor principles so that the fluid mixes with plant water provided by conduit 156. The mixed stream of fluid and plant water flows from eductor 154 through conduit 160 to floor drain 136 or a waste disposal system (not shown). During this step of the cleaning process, pump 116 is not used.

Figure 6:
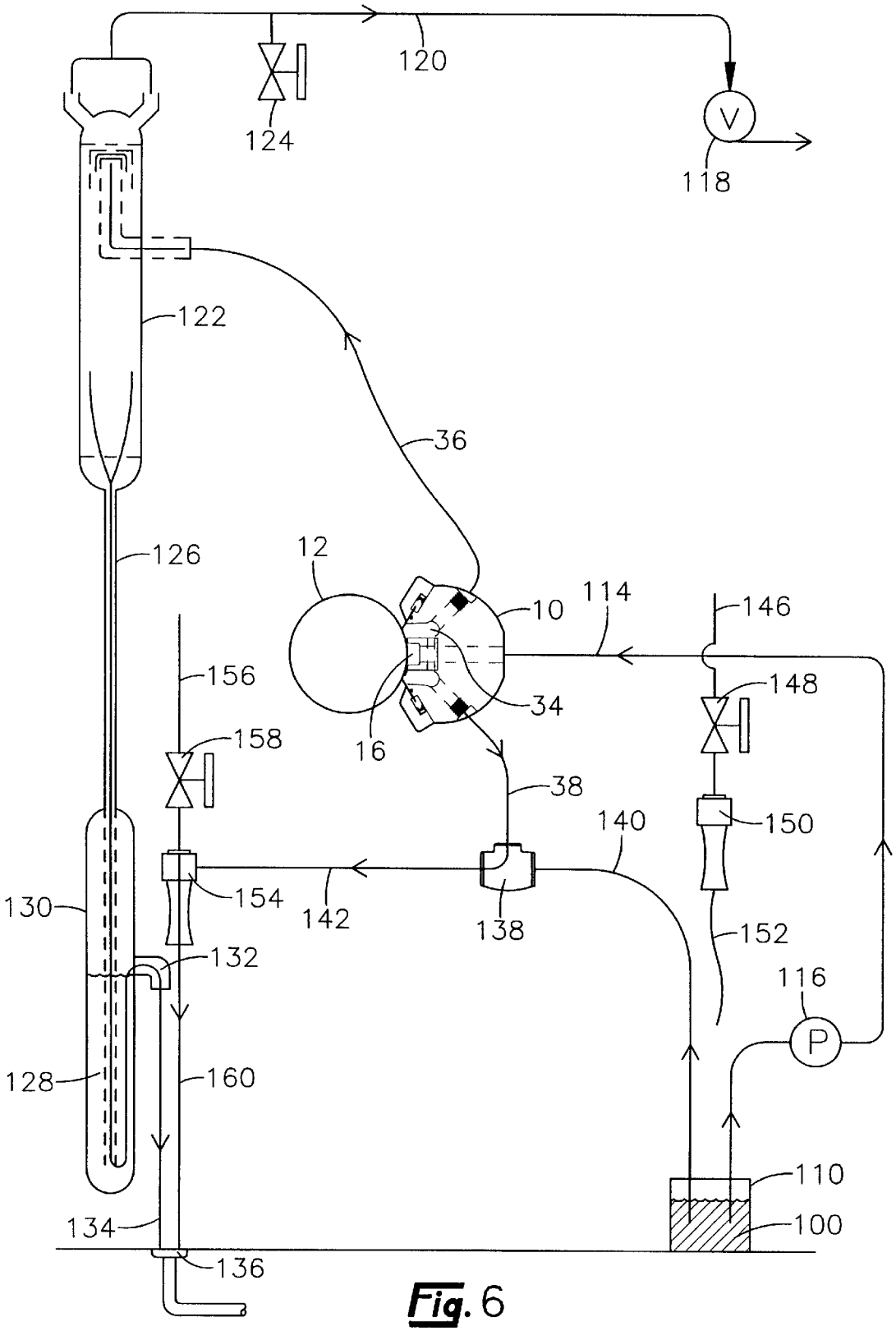

With reference to FIG. 6, fresh water is added to reservoir 110 by opening valve 148 so that water flows through conduits 146 and 152 into reservoir 110. After filling the reservoir 110 with fresh water, pump 116 is operated to pump water through conduit 114 to the nozzle 16. Vacuum pump 118 is also operated to provide a differential pressure between nozzle 16 and chamber 34 for high velocity cleaning of the apparatus 10 and cylinder 12.

During this step of the cleaning process, three-way valve 138 is operated to allow flow of fluid from chamber 34 through conduits 38 and 142 to eductor 154. Water is caused to flow through eductor 154 by opening valve 158 in conduit 156. As the fluid from chamber 34 is drawn through conduit 142 by eductor 154, it mixes with water and flows through conduit 160 to floor drain 136 or a waste disposal system (not shown).

Also during this step of the cleaning process, valve 124 may be closed for a period time, usually about 4 to 5 seconds in order to increase the vacuum in fluid collection chamber 34 to up to about 120 inches (305 cm) of water thereby drawing fluid through conduit 36 into separator vessel 122. The flow of water into the separator vessel 122 cleans the vessel and interconnecting conduit. Water drawn into the separator vessel flows through conduit 126 to seal pot vessel 130 wherein it overflows through overflow drain 132 through conduit 134 to floor drain 136 or the waste disposal system.

Figure 7:
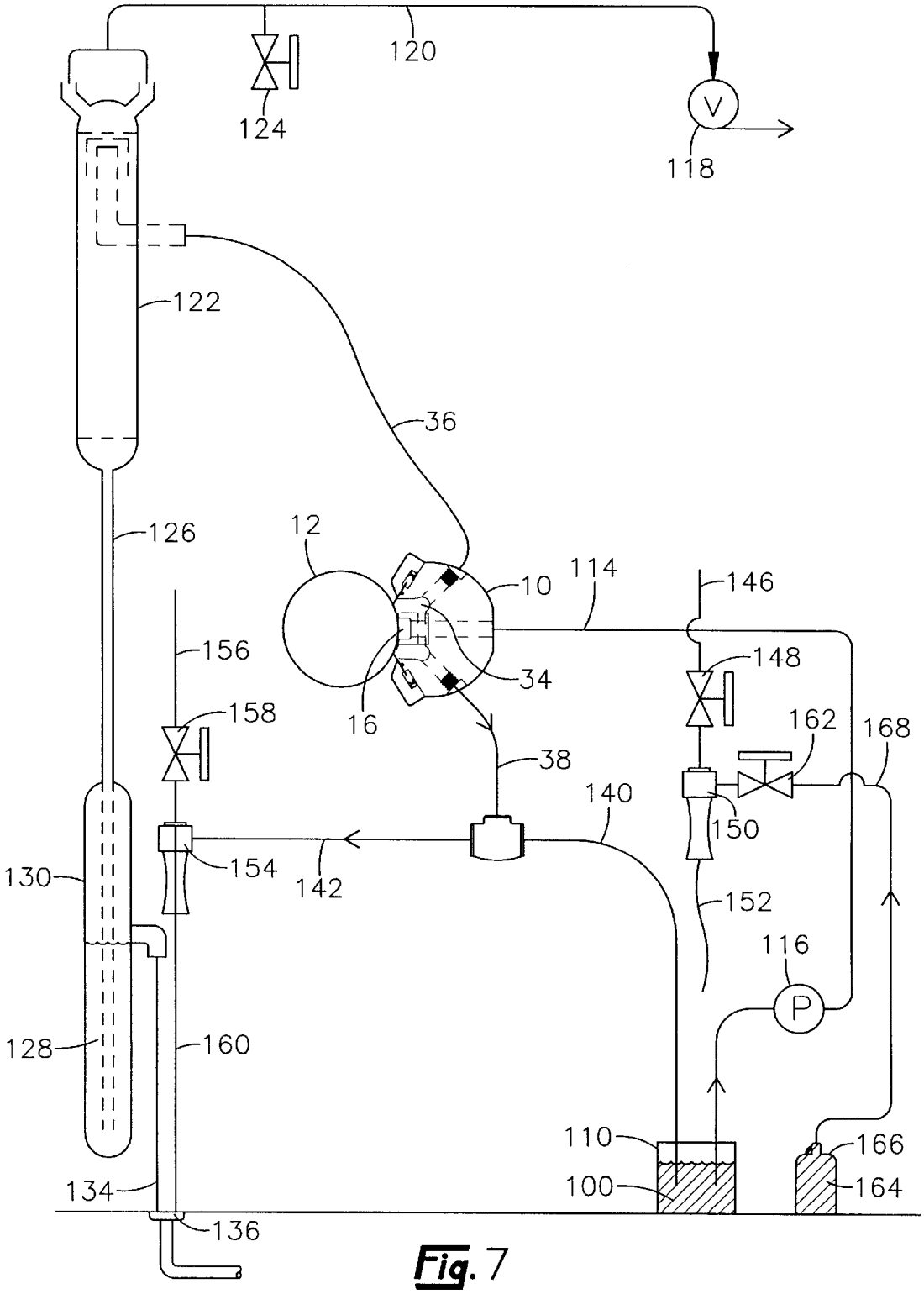

As shown in FIG. 7, after rinsing the nozzle 16, chamber 34 and associated conduits, valves 148 and 162 may be opened to flow a soap 164 or other cleaning solvent from solvent vessel 166 through conduit 168 to eductor 150 wherein it mixes with water from conduit 146 and flows to reservoir 110 to form a soap or solvent mixture 100. The soap or solvent mixture 100 in reservoir 110 may then be pumped by pump 116 through the nozzle as illustrated by the process described with reference to FIGS. 3 and 4 or it may be removed from the vessel by the process illustrated in FIGS. 5 and 6 and described above. After cleaning the nozzle 16, chamber 34 and associated conduits with the soap or solvent mixture 100, any or all of the foregoing described process steps illustrated in FIGS. 3, 4, 5 and 6 may be used to rinse any remaining soap or solvent mixture 100 out of the nozzle 16, chamber 34 and associated conduits. In addition, any or all of the previously described process steps may be repeated for further cleaning of the inking system.

As illustrated and described above, the apparatus according to the invention provides a means for increasing the pressure and velocity of ink applied to the cylinder of a printing machine and provides a means for enhanced cleaning of the cylinder between ink changes. The cleaning system is capable of providing a high volume of high pressure cleaning fluid by means of the nozzle to the cylinder surface thereby improving the cleaning thereof. Because a large volume of cleaning fluid may be circulated through the system, all of the parts and conduits of the system may be cleaned without disassembling any of the components.

Having described and illustrated preferred embodiments of the invention, it will be appreciated that various modifications, rearrangements and substitutions made to the invention by those of ordinary skill are within the spirit and scope of the appended claims.

What is claimed is:

1. An apparatus for delivering a flow of fluid onto the surface of an elongate cylinder having a cylindrical exterior surface, the apparatus comprising an elongate housing having an opening positionable adjacent the exterior surface of the cylinder and a fluid collection chamber, an elongate nozzle in said housing contained within said fluid collection chamber and in fluid flow communication therewith and projectable through said opening of said housing for placement in close proximity to the exterior surface of the cylinder, said nozzle having a length about equal the length of the cylinder and a width less than the diameter of the cylinder, a first conduit connecting said fluid collection chamber in fluid flow communication with a vacuum device for establishing a reduced pressure in said chamber through the first conduit, a second conduit connecting said fluid collection chamber in fluid flow communication with a fluid reservoir for conducting a flow of fluid into the reservoir from said collection chamber, a fluid transfer device connecting the fluid reservoir in fluid flow communication with said nozzle for supplying fluid from said reservoir to said nozzle under pressure and elongate wiper seals disposed adjacent said opening of said housing oriented substantially parallel to the length of said housing positionable in close adjacency with the exterior surface of the cylinder.

2. The apparatus of claim 1 wherein the nozzle contains elongate metering seals positionable adjacent the exterior surface of the cylinder.

3. The apparatus of claim 2 wherein the metering seals have a gap ranging from about 0.003 inch to about 0.005 inch.

4. The apparatus of claim 1 further comprising a multi-port valve in the second conduit for directing fluid from the fluid collection chamber to either the fluid reservoir or a waste disposal system.

5. The apparatus of claim 1 further comprising journal bearings adjacent opposing ends of the housing attached to an axle for the elongate cylinder for moving the housing in an arcuate direction relative to the external surface of the cylinder between about 15° above a horizontal axis perpendicular to the surface and about 45° below the horizontal axis.

6. The apparatus of claim 1 wherein the fluid transfer device is selected from the group consisting of a centrifugal pump, a positive displacement pump, a diaphragm pump and an eductor.

7. The apparatus of claim 1 wherein the elongate wiper seals are disposed on opposing sides of the housing.

8. The apparatus of claim 7 wherein the wiper seals are elongate doctor blades.

9. A method for inking an elongate anilox or gravure cylinder having an exterior surface which comprises providing an inking device comprising elongate housing having an opening positionable adjacent the exterior surface of the cylinder and an ink collection chamber, an elongate nozzle in the housing contained within the ink collection chamber and in fluid flow communication therewith and projectable through the opening of the housing for placement in close proximity to the exterior surface of the cylinder, said nozzle having a length about equal the length of the cylinder and a width less than the diameter of the cylinder, a first conduit connecting said ink collection chamber in fluid flow communication with a vacuum device for establishing a reduced pressure in said chamber through said first conduit, a second conduit connecting said fluid chamber in fluid flow communication with an ink reservoir for conducting a flow of ink into the reservoir from said collection chamber, an ink transfer device connecting said ink reservoir in fluid flow communication with said nozzle for supplying ink from said reservoir to said nozzle under pressure and elongate wiper seals disposed adjacent said opening of said housing oriented substantially parallel to the length of said housing positionable in close adjacency with the exterior surface of the cylinder and feeding ink to the nozzle under pressure sufficient to substantially fill cells or indentations on the exterior surface of the cylinder.

10. The method of claim 9 wherein the inking device further comprises journal bearings adjacent opposing ends of the housing attached to an axle for the elongate cylinder for moving the housing in an arcuate direction relative to the external surface of the cylinder to a position between about 15° above a horizontal axis perpendicular to the surface and about 45° below the horizontal axis prior to inking the cylinder.

11. The method of claim 9 further comprising providing a reduced pressure in the collection chamber while feeding ink to the nozzle.

12. A method for cleaning a printing cylinder having an exterior cylindrical surface which comprises providing a cleaning device comprising an elongate housing having an opening positionable adjacent the exterior surface of the cylinder and a fluid collection chamber, an elongate nozzle in the housing contained within the fluid collection chamber and in fluid flow communication therewith and projectable through the opening of the housing for placement in close proximity to the exterior surface of the cylinder, said nozzle having a length about equal the length of the cylinder and a width less than the diameter of the cylinder, a first conduit connecting said fluid collection chamber in fluid flow communication with a vacuum device for establishing a reduced pressure in said chamber through said first conduit, a second conduit connecting said fluid chamber in fluid flow communication with a fluid reservoir for conducting a flow of fluid into the reservoir from said collection chamber, a fluid transfer device connecting said fluid reservoir in fluid flow communication with said nozzle for supplying fluid from said reservoir to said nozzle under pressure and elongate wiper seals disposed adjacent said opening of said housing oriented substantially parallel to the length of said housing positionable in close adjacency with the exterior surface of the cylinder and feeding a cleaning fluid to the nozzle under pressure sufficient to substantially fill cells or indentations on the exterior surface of the cylinder.

13. The method of claim 12 wherein the cleaning device further comprises journal bearings adjacent opposing ends of the housing attached to an axle for the elongate cylinder for moving the housing in an arcuate direction relative to the external surface of the cylinder to a position between about 15° above a horizontal axis perpendicular to the surface and about 45° below the horizontal axis prior to cleaning the cylinder.

14. The method of claim 12 further comprising providing a reduced pressure in the collection chamber while feeding cleaning fluid to the nozzle.

15. A printing machine comprising an elongate printing cylinder having an exterior cylindrical surface, said cylinder rotating about its longitudinal axis on a cylinder axle, an elongate housing attached in close proximity to the cylinder, said housing having an opening positionable adjacent the exterior surface of the cylinder and a fluid collection chamber, an elongate nozzle in the housing contained within the fluid collection chamber and in fluid flow communication therewith and projectable through the opening of the housing for placement in close proximity to the exterior surface of the cylinder, said nozzle having a length about equal the length of the cylinder, a width less than the diameter of the cylinder and elongate metering seals positionable adjacent the exterior surface of the cylinder, said printing machine further comprising journal bearings adjacent opposing ends of the housing attached to the cylinder axle for moving the housing in an arcuate direction relative to the external surface of the cylinder between about 15° above a horizontal axis perpendicular to the surface and about 45° below the horizontal axis, a first conduit connecting said fluid collection chamber in fluid flow communication with a vacuum pump for establishing a reduced pressure in said chamber through said first conduit, a second conduit connecting said fluid chamber in fluid flow communication with a fluid reservoir for conducting a flow of fluid into the reservoir from said collection chamber, a pump connecting said fluid reservoir in fluid flow communication with said nozzle for supplying fluid from said reservoir to said nozzle under pressure and elongate wiper seals attached to the housing on opposing ends thereof adjacent said opening of said housing and oriented substantially parallel to the length of said housing so that the seals are positionable in close adjacency with the exterior surface of the cylinder.

16. The printing machine of claim 15 wherein the metering seals have a gap ranging from about 0.003 inch to about 0.005 inch.

17. The printing machine of claim 15 further comprising a multi-port valve in the second conduit for directing fluid from the fluid collection chamber to either the fluid reservoir or a waste disposal system.

18. The printing machine of claim 15 wherein the wiper seals are elongate doctor blades.

19. The printing machine of claim 15 wherein the printing cylinder is an anilox roll.

20. The printing machine of claim 15 wherein the machine is a flexographic printing machine.

* * * * *

UNITED STATES PATENT AND TRADEMARK OFFICE

CERTIFICATE OF CORRECTION

PATENT NO : 5,768,993

DATED : June 23, 1998

INVENTOR(S) : Warner Hugh Stuart

It is certified that error appears in the above-identified patent and that said Letters Patent hereby corrected as shown below:

IN THE ABSTRACT: line 4, change "havingan" to -- having an --.

Column 3, line 33, before "cylinder" insert -- printing --.

Column 4, line 9 , change "$in^2$" to -- $in^3$ --.

Column 4, line 10, change "$in^2$" to -- $in^3$ --.

Column 4, lines 34, change "$in^2$" to -- $in^3$ --.

Column 5, line 48, change "holder 44" to -- holders 44 and 46 --.

Column 5, lines 62-63, change "gaps 22 and 24" to -- gap 32 --.

Column 7, line 6, after "valve" insert -- 138 --.

Signed and Sealed this

Tenth Day of November 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,768,993
DATED : June 23, 1998
INVENTOR(S) : Warner Hugh Stuart

It is certified that error appears in the above-identified patent and that said Letters Patent is hereby corrected as shown below:

Column 9, line 28, change "further comprises" to --contains--.

Column 9, line 31, after "cylinder" insert --, the method further comprising moving the housing in an arcuate direction relative to the surface of the ink transfer cylinder--; change "between" to --at from--.

Column 9, line 32, change "and" to --to--.

Column 9, line 38, change "a printing" to --an ink transfer--.

Column 10, line 7, after "cylinder" insert --, the method further comprising moving the housing in an arcuate direction relative to the surface of the ink transfer cylinder--.

Column 10, line 7, change "between" to --at from--.

Column 10, line 8, change "and" to --to--.

Column 10, line 14, change "printing" to --ink transfer--.

Signed and Sealed this

Ninth Day of March, 1999

*Attest:*

Q. TODD DICKINSON

*Attesting Officer*

*Acting Commissioner of Patents and Trademarks*